US009409422B2

(12) United States Patent
Kawamata

(10) Patent No.: US 9,409,422 B2
(45) Date of Patent: Aug. 9, 2016

(54) INK-JET RECORDING APPARATUS

(71) Applicant: Brother Kogyo Kabushiki Kaisha, Nagoya-shi, Aichi-ken (JP)

(72) Inventor: Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/886,384

(22) Filed: Oct. 19, 2015

(65) Prior Publication Data

US 2016/0039224 A1 Feb. 11, 2016

Related U.S. Application Data

(63) Continuation of application No. 14/598,382, filed on Jan. 16, 2015, now Pat. No. 9,162,493, which is a continuation of application No. 14/305,576, filed on Jun. 16, 2014, now Pat. No. 8,950,857, which is a continuation of application No. 13/629,906, filed on Sep. 28, 2012, now Pat. No. 8,789,940.

(30) Foreign Application Priority Data

Nov. 28, 2011 (JP) ..... 2011-259604

(51) Int. Cl.

| | |
|---|---|
| ***B41J 11/00*** | (2006.01) |
| ***B41J 11/04*** | (2006.01) |
| ***B41J 11/14*** | (2006.01) |
| ***B41J 11/20*** | (2006.01) |
| ***B41J 2/01*** | (2006.01) |
| *B41J 11/02* | (2006.01) |

(52) U.S. Cl.

CPC .. *B41J 11/04* (2013.01); *B41J 2/01* (2013.01); *B41J 11/0035* (2013.01); *B41J 11/14* (2013.01); *B41J 11/20* (2013.01); *B41J 11/00* (2013.01); *B41J 11/02* (2013.01)

(58) Field of Classification Search

None

See application file for complete search history.

(56) References Cited

U.S. PATENT DOCUMENTS

| | | | |
|---|---|---|---|
| 6,896,432 | B2 | 5/2005 | Ohyama |
| 7,232,269 | B2 | 6/2007 | Ohyama |

(Continued)

FOREIGN PATENT DOCUMENTS

| | | | |
|---|---|---|---|
| CN | 1861412 | A | 11/2006 |
| CN | 202895930 | U | 4/2013 |

(Continued)

OTHER PUBLICATIONS

Computer-generated translation of JP 2000-249664, published on Sep. 2004.

(Continued)

*Primary Examiner* — Huan Tran

(74) *Attorney, Agent, or Firm* — Banner & Witcoff, Ltd.

(57) ABSTRACT

There is provided an ink-jet recording apparatus including: a transporting roller; a driven roller provided opposite the transporting roller to sandwich the recording medium between the driven roller and the transporting roller, while moving in an approaching-departing direction based on a thickness of the recording medium; a first biasing member biasing the driven roller to the transporting roller; a platen; a recording portion configured to jet ink droplets from nozzles; and a cooperative portion moving along with the movement of the driven roller in the approaching-departing direction to move the platen.

3 Claims, 12 Drawing Sheets

(56) References Cited

U.S. PATENT DOCUMENTS

| | | | | |
|---|---|---|---|---|
| 7,735,991 | B2 | 6/2010 | Asano | |
| 8,789,940 | B2 * | 7/2014 | Kawamata | 347/104 |
| 8,950,857 | B2 * | 2/2015 | Kawamata | 347/104 |
| 9,162,493 | B2 * | 10/2015 | Kawamata | |
| 2006/0256180 | A1 | 11/2006 | Asano | |
| 2008/0218578 | A1 | 9/2008 | Ishihara et al. | |
| 2013/0135412 | A1 | 5/2013 | Kawamata | |
| 2013/0135413 | A1 | 5/2013 | Ito et al. | |
| 2014/0292987 | A1 | 10/2014 | Kawamata | |

FOREIGN PATENT DOCUMENTS

| | | | |
|---|---|---|---|
| JP | 11-138923 | A | 5/1999 |
| JP | 2004-249664 | A | 9/2004 |
| JP | 2006-315272 | A | 11/2006 |

OTHER PUBLICATIONS

Oct. 10, 2014—(CN) Notification of First Office Action—App. 201210369840.6—Eng Tran.

* cited by examiner

INK-JET RECORDING APPARATUS

CROSS REFERENCE TO RELATED APPLICATION

The present application is a continuation of U.S. patent application Ser. No. 14/598,382 filed Jan. 16, 2015, which is a continuation of U.S. patent application Ser. No. 14/305,576 filed Jun. 16, 2014, issued as U.S. Pat. No. 8,950,857 on Oct. 2, 2014, which is a continuation of U.S. patent application Ser. No. 13/629,906 filed Sep. 28, 2012, issued as U.S. Pat. No. 8,789,940 on Jul. 29, 2014, which claims priority from Japanese Patent Application No. 2011-259604, filed on Nov. 28, 2011. The disclosures of the above-noted applications are incorporated herein by reference in their entirety.

BACKGROUND OF THE INVENTION

1. Field of the Invention

The present invention relates to ink-jet recording apparatuses recording images on recording media.

2. Description of the Related Art

Conventionally, ink-jet recording apparatuses have been known to include a recording section configured to record images on a recording medium transported through a transport path, by an ink-jet recording method. As the recording medium transported in such an ink-jet recording apparatus, not only thin recording paper but also thicker glossy paper and postcards are utilized.

Further, in such an ink-jet recording apparatus, when recording images on a recording medium, the recording medium is supported on a platen. At this time, it is required to adjust a gap between the recording section and the recording medium supported on the platen with a high precision. However, the abovementioned gap varies with the thickness of the recording medium. As a result, it is undesirably possible to degrade the quality of the images recorded on the recording medium.

In order to solve such problems, there are known recording apparatuses having a mechanism configured to move the platen between two predetermined positions. By virtue of this, it is possible to change the position of the platen with a thin recording medium such as recording paper and the like, or with a thick recording medium such as postcards and the like. As a result, it is possible to adjust the abovementioned gap between the recording section and the recording medium.

However, in the ink-jet recording apparatus, recording media of various types of thickness are transported. Further, even for recording media of the same type, thickness may still vary according to each recording medium. That is, the thickness of the transported recording media is an indefinite factor.

SUMMARY OF THE INVENTION

The present invention is made in view of the above problems, and an object thereof is to provide an ink-jet recording apparatus capable of keeping an invariant gap between a recording medium and the recording portion without depending on thickness of the recording medium.

According to a first aspect of the present teaching, there is provided an ink-jet recording apparatus including:

a transporting roller provided in a transport path through which a recording medium is guided, and configured to transport the recording medium along the transport path in a transporting direction;

a driven roller provided opposite the transporting roller to sandwich the recording medium between the driven roller and the transporting roller to transport the recording medium along the transport path, while moving in an approaching-departuring direction to approach to or depart from the transporting roller based on a thickness of the recording medium sandwiched between the driven roller and the transporting roller;

a first biasing member biasing the driven roller to the transporting roller;

a platen provided below the transport path on the downstream side from the transporting roller in the transporting direction, and configured to support the recording medium transported through the transport path;

a recording portion provided above the transport path to face the platen, and configured to jet ink droplets from nozzles to record the image on the recording medium supported on the platen; and a cooperative portion configured to move along with the movement of the driven roller in the approaching-departuring direction to move the platen.

In this case, the driven roller moves a distance equal to the thickness of the recording medium in the approaching-departuring direction by sandwiching the recording medium between the driven roller and the transporting roller. As the driven roller moves in the approaching-departuring direction, the platen supporting the recording medium is thus moved as much as the thickness of the recording medium due to the cooperative portion. That is, the movement distance of the platen is identical to the thickness of the recording medium in the approaching-departuring direction.

According to a second aspect of the present teaching, there is provided an ink-jet recording apparatus including:

a transporting roller provided in a transport path through which a recording medium is guided, and configured to transport the recording medium along the transport path in a transporting direction;

a driven roller provided to face the transporting roller, and configured to sandwich the recording medium between the driven roller and the transporting roller to transport the recording medium along the transport path, while moving in an approaching-departuring direction to approach to or depart from the transporting roller based on a thickness of the recording medium sandwiched between the driven roller and the transporting roller;

a first biasing member biasing the driven roller to the transporting roller;

a platen provided below the transport path on the downstream side of the transporting roller in the transporting direction, and configured to support the recording medium transported through the transport path;

a recording portion provided above the transport path to face the platen, and configured to jet ink droplets from nozzles formed in the recording portion to record the image on the recording medium supported on the platen;

a support member rotatably supporting the driven roller and integrally moving with the driven roller;

a contact portion disposed on the platen and configured to come into contact with the support member;

a contacted portion disposed on the support member to be contacted by the contact portion; and a second biasing member biasing the platen to the support member, wherein the platen moves in such a direction that the contact portion approaches to or departs from the contacted portion.

According to a third aspect of the present teaching, there is provided an ink-jet recording apparatus including:

a first roller provided in a transport path through which the recording medium is guided, and configured to transport a recording medium along the transport path in a transporting direction;

a second roller configured to sandwich the recording medium between the second roller and the first roller to transport the recording medium in the transporting direction, while moving in an approaching-departuring direction to approach to or depart from the first roller based on a thickness of the recording medium;

a biasing member biasing the second roller to the first roller;

a platen provided on the downstream side of the first roller in the transporting direction;

a recording portion configured to jet ink droplets from nozzles onto the recording medium supported by the platen; and a cooperative portion configured to move along with the movement of the second roller in the approaching-departuring direction to move the platen.

According to the present teaching, the platen moves a distance identical to the thickness of the recording medium. Therefore, it is possible to keep an invariant gap between the recording portion and the recording medium supported on the platen without depending on thickness of the recording medium.

DESCRIPTION OF THE PREFERRED EMBODIMENT

Figure 1:
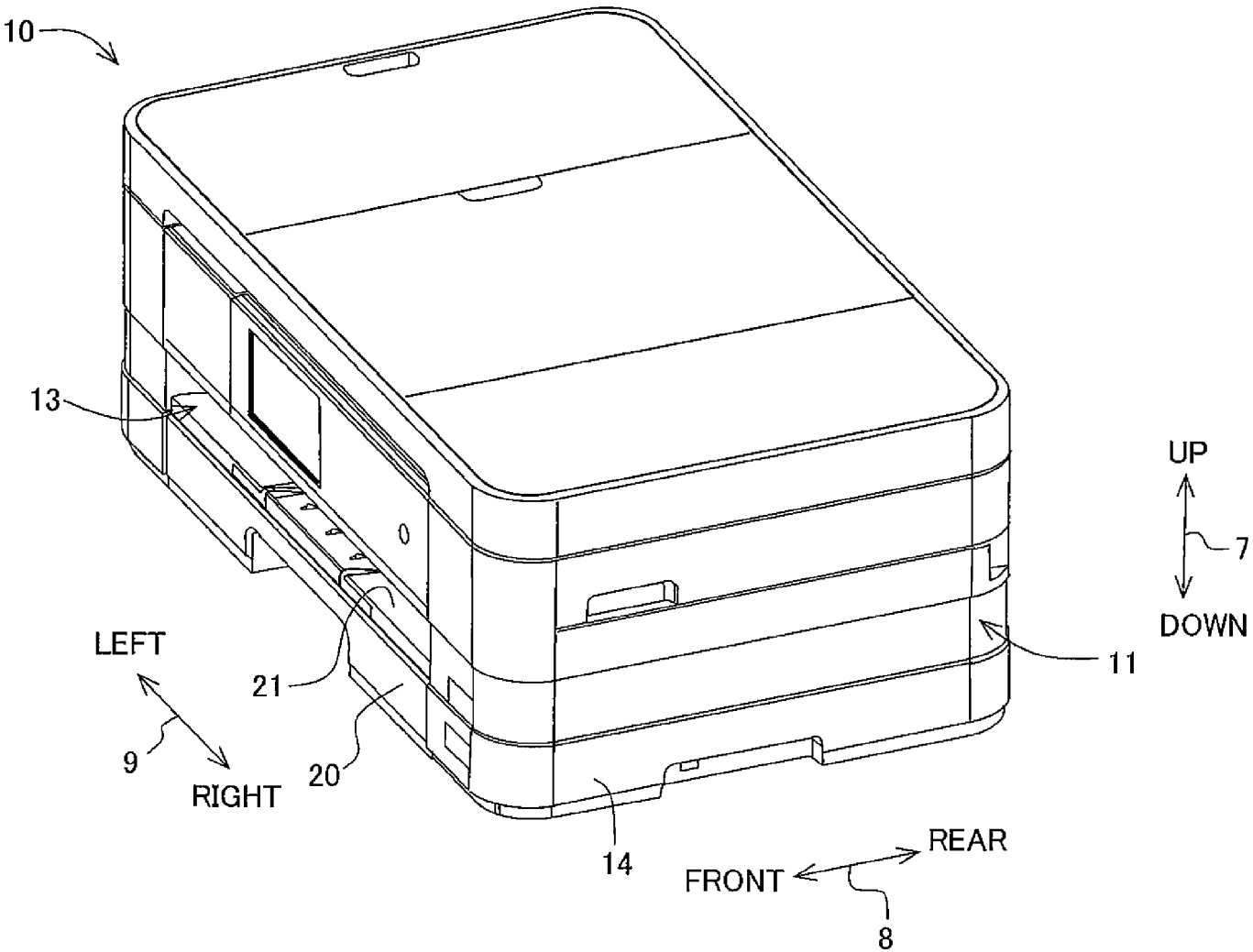
FIG. 1 is a perspective external view of a multifunction printer 10 as an example of the ink-jet recording apparatus in accordance with an embodiment of the present teaching.

Hereinbelow, an embodiment of the present teaching will be explained. Further, it is needless to say that the embodiment explained below is merely an example of the present teaching, and thus it is possible to change the embodiment of the present teaching as appropriate without departing from the scope of the present teaching. Further, the term "direction" includes both of the meaning "one-way direction" and "two-way direction". The words "one-way direction" means a direction from starting point to ending point of an arrow, and the words "two-way direction" means the direction from starting point to ending point and the direction from ending point to starting point of the arrow. Further, in the following explanations, an up-down direction 7 is defined based on a reference state (see in FIG. 1) in which a multifunction printer 10, which is an example of the ink-jet recording apparatus of the present teaching, is placed to be operable; a front-rear direction 8 is defined so that a side in which an opening 13 is provided is the front side (front face); and a left-right direction 9 is defined as the multifunction printer 10 is viewed from the front side (front face).

[An Overall Configuration of the Multifunction Printer 10]

Figure 2:
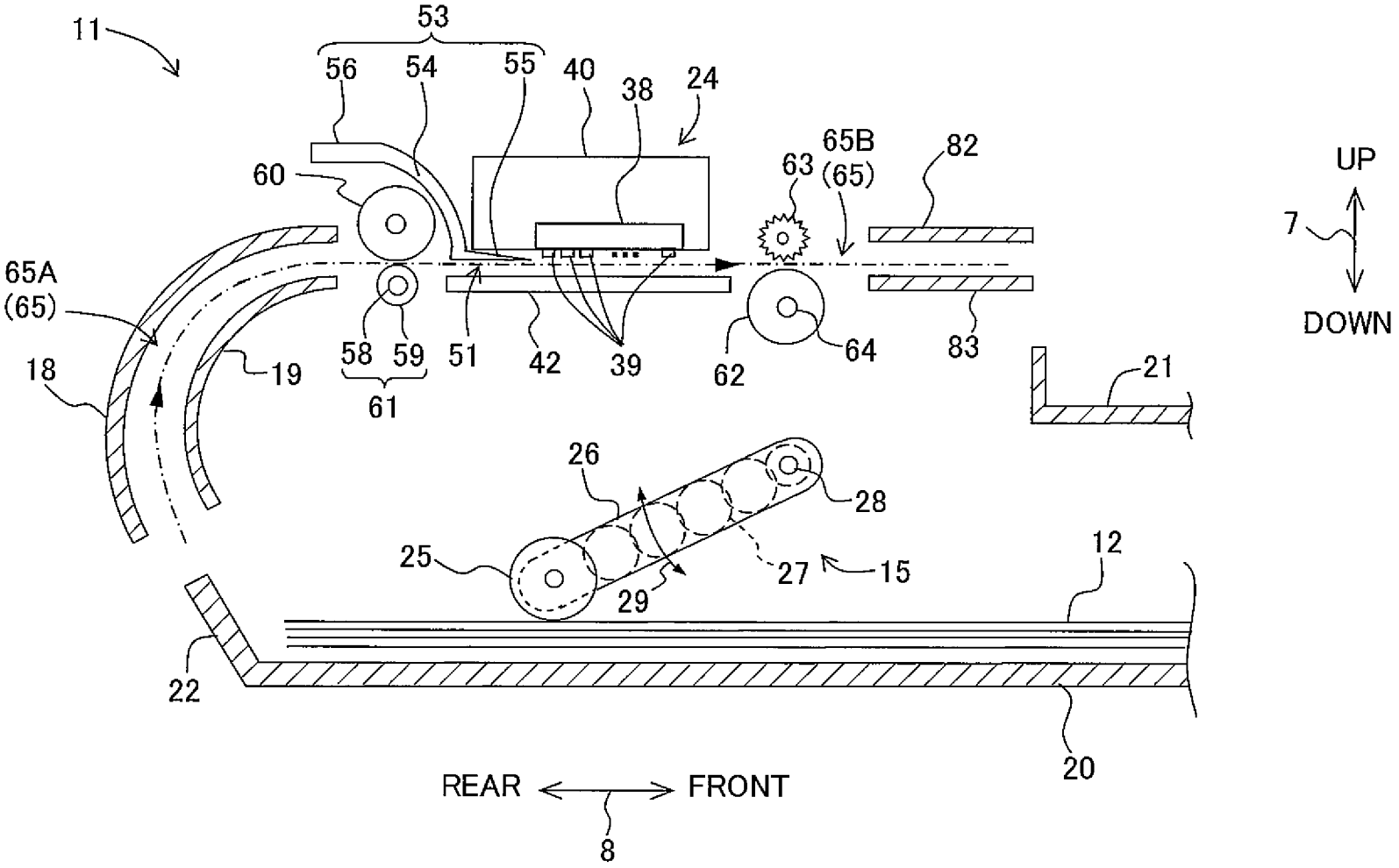
FIG. 2 is a longitudinal sectional view modally showing an inner structure of a printer portion 11.

As shown in FIG. 1, the multifunction printer 10 is formed into an approximate cuboid, and a printer section 11 is provided in a lower portion of the multifunction printer 10 so that the printer section 11 records images on a recording paper 12 (an example of the recording medium of the present teaching; see FIG. 2) by an ink-jet recording method. The multifunction printer 10 has various functions such as a facsimile function, a print function, and the like. Further, in this embodiment, the multifunction printer 10 only has a single-sided image recording function. However, it may as well have a both-sided image recording function.

The printer section 11 has a case 14 having an opening 13 formed in its front side. Further, a paper feeding tray 20 and a paper discharging tray 21 capable of loading the recording paper 12 of various sizes are formed to be insertable to and removable from the opening 13 in the front-rear direction 8.

As shown in FIG. 2, the printer section 11 includes a paper feeding portion 15 to pick up and feed the recording paper 12 from the paper feeding tray 20, a recording portion 24 of an ink-jet recording method (an example of the recording portion of the present teaching) provided above the paper feeding tray 20 to record images on the recording paper 12 by jetting ink droplets onto the recording paper 12 fed by the paper feeding portion 15, a first transporting roller 60 (an example of the transporting roller of the present teaching), a second transporting roller 62 (an example of the discharging roller of the present teaching), and the like.

[The Paper Feed Portion 15]

As shown in FIG. 2, the paper feeding portion 15 is provided above the paper feeding tray 20 and below the recording portion 24. The paper feeding portion 15 includes a feeding roller 25, a paper feeding arm 26, and a driving force transmission mechanism 27. The feeding roller 25 is pivotally supported at an end portion of the paper feeding arm 26. The paper feeding arm 26 revolves in a direction along an arrow 29 about a shaft 28 provided in its basal end portion. By virtue of this, the feeding roller 25 is able to contact with or depart from the paper feeding tray 20. That is, the feeding roller 25 is able to contact with the recording paper 12 loaded on the paper feeding tray 20.

A paper feeding motor (not shown) transmits a driving force to the feeding roller 25 to rotate the same. The feeding roller 25 sends out a sheet of the recording paper 12 to a curved path 65A explained below by separating it from other sheets if the recording paper 12 in a state of contact with the uppermost sheet of the recording paper 12 among the recording paper 12 placed on the paper feeding tray 20.

[A Transport Path 65]

As shown in FIG. 2, a transport path 65 (an example of the transport path of the present teaching) is formed in the printer section 11 at a portion from an end portion of the paper feeding tray 20 (the end portion on the rear side) through the recording portion 24 up to the paper discharging tray 21. The transport path 65 is divided into the curved path 65A formed from the end portion of the paper feeding tray 20 up to the first transporting roller 60, and a paper discharge path 65B formed from the first transporting roller 60 up to the paper discharging tray 21.

The curved path 65A is a curved passage provided to extend from the vicinity of the upper end of a separation inclined plate 22 provided on the paper feeding tray 20 up to the recording portion 24. The recording paper 12 fed from the paper feeding tray 20 by the feeding roller 25 is curved in a transporting direction along the curved path 65A (the direction or orientation of the arrow assigned to the chain line in FIG. 2; an example of the transporting direction of the present teaching), and guided to a position of sandwiching the recording paper 12 by the first transporting roller 60 and a pinch roller 61 (an example of the driven roller of the present teaching). The curved path 65A is defined by an outer guide member 18 and an inner guide member 19 facing each other at a predetermined gap.

The paper discharge path 65B is a linear passage provided to extend from the position of sandwiching the recording paper 12 by the first transporting roller 60 and the pinch roller 61 up to the paper discharging tray 21. The recording paper 12 is guided through the paper discharge path 65B in the transporting direction. The paper discharge path 65B is defined by the recording portion 24, and a platen 42 (an example of the platen of the present teaching) which is a plate-like member capable of supporting the recording paper 12, facing each other at a predetermined gap where the recording portion 24 is provided. Further, the paper discharge path 65B is defined by an upper guide member 82 and a lower guide member 83 facing each other at a predetermined gap where the recording portion 24 is not provided.

[The Platen 42]

As shown in FIG. 2, the platen 42 is provided in the paper discharge path 65B on the downstream side from the first transporting roller 60 in the transporting direction. The platen 42 is provided below the paper discharge path 65B. The platen 42 is supported by a frame (not shown) of the printer section 11 on both ends in the left-right direction 9.

Figure 3:
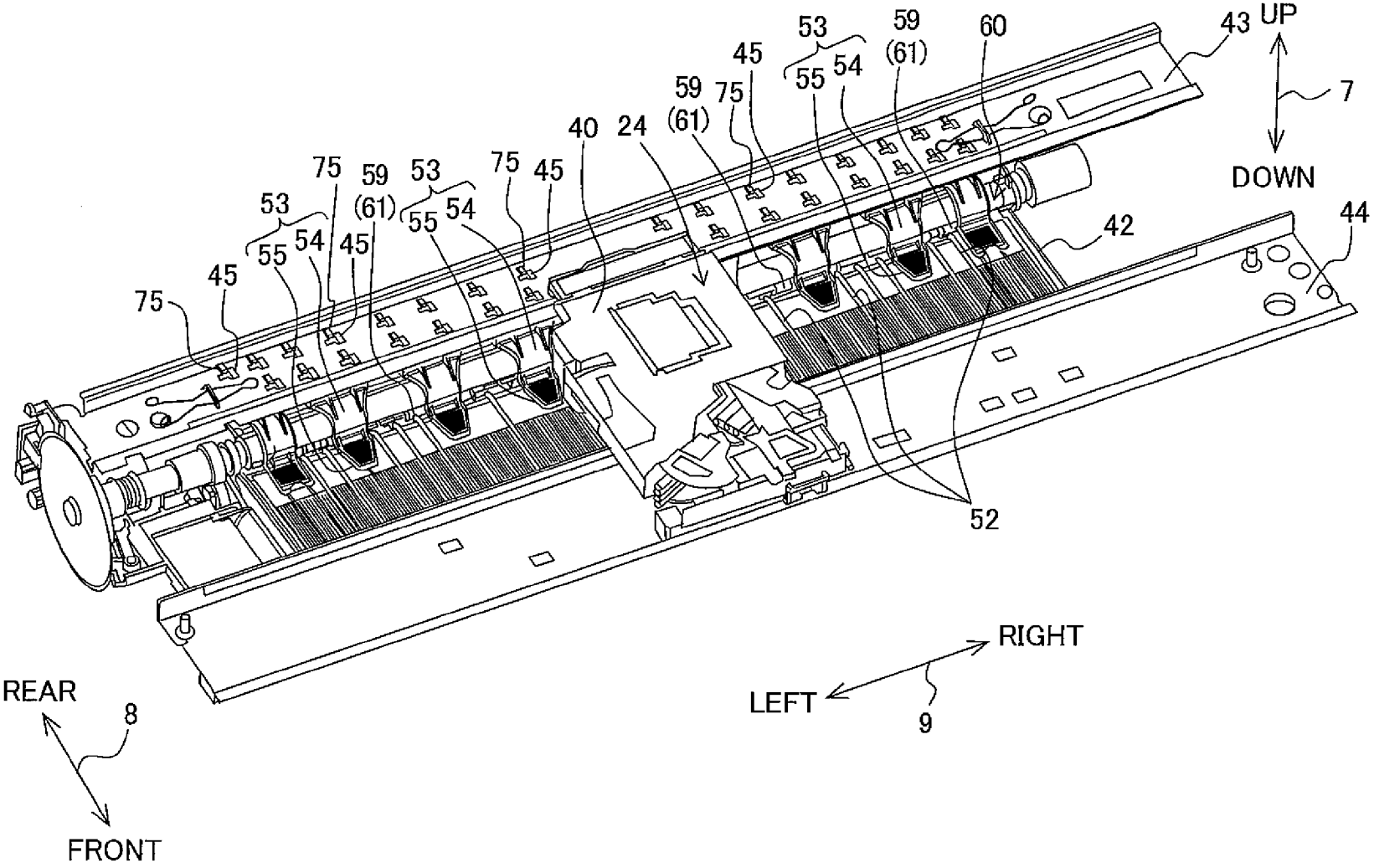
FIG. 3 is a perspective view showing a recording portion 24, a platen 42, and guide rails 43 and 44.
Figure 5:
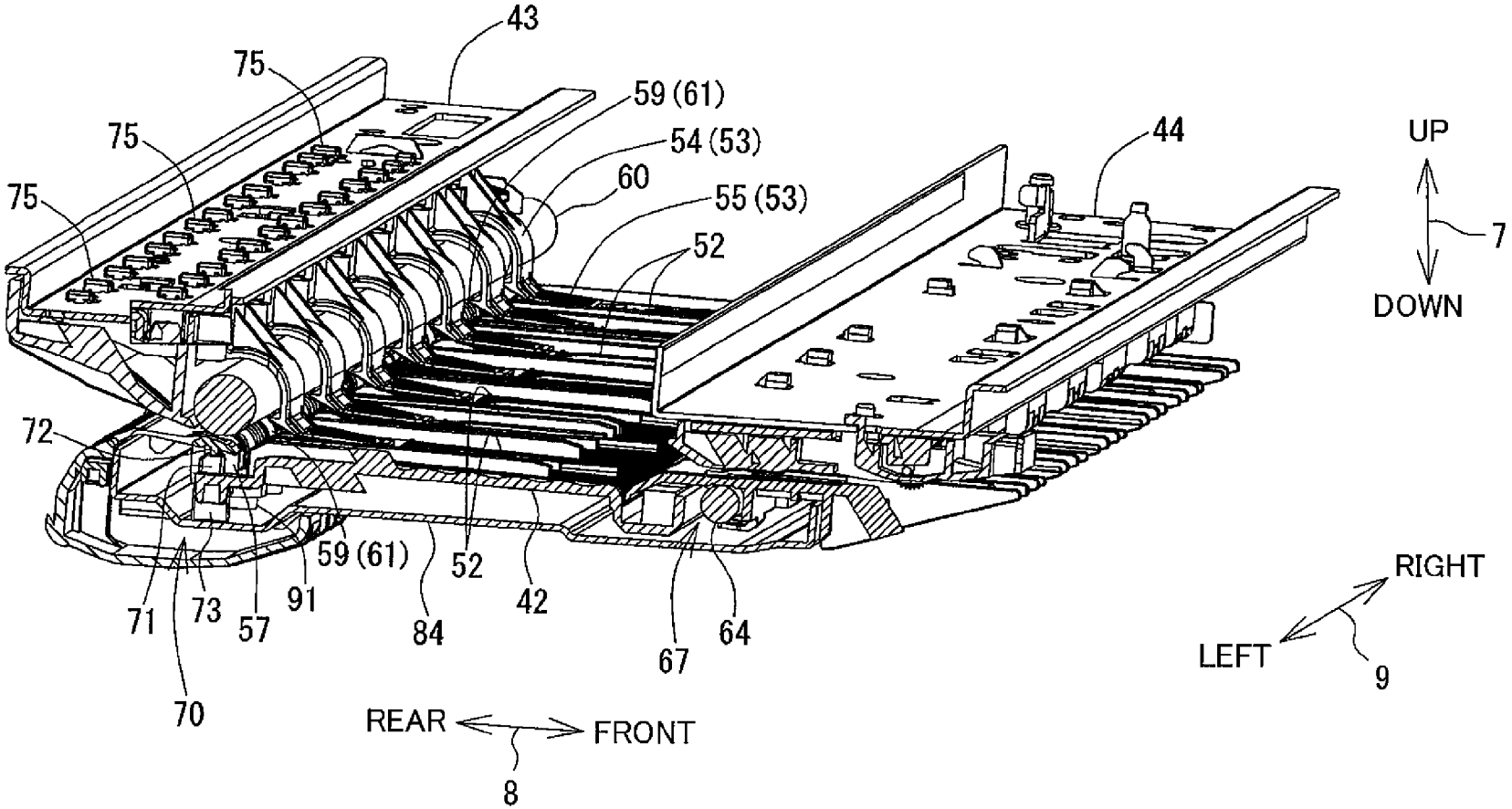
FIG. 5 is a perspective view showing a first transporting roller 60, a pinch roller 61, the platen 42, and the guide rails 43 and 44.

As shown in FIGS. 2, 3 and 5, the platen 42 is shaped into an approximately flat plate longer in the front-rear direction 8 and the left-right direction 9 than in the up-down direction 7 in a state of being supported by the frame. On the upper surface of the platen 42, a plurality of ribs 52 (an example of the projection of the present teaching) are formed to project upward.

Each of the ribs 52 extends in the front-rear direction 8. In detail, the ribs 52 each extend in the front-rear direction 8 at least in the positions facing nozzles 39 which will be described hereinafter. In this embodiment, the ribs 52 each extend in the front-rear direction 8 in the positions facing lower surfaces 51 of holding portions 55 of a holding member 53 which will also be described hereinafter (see FIGS. 2 and 4), in addition to the positions facing the nozzles 39. Here, the holding portions 55 are, as described below, provided on the upstream side to the nozzles 39 in the transporting direction. That is, the ribs 52 each extend in the front-rear direction 8 up to the downstream side from the positions facing the lower surfaces 51 of the holding portions 55 in the transporting direction.

Further, the ribs 52 are formed at predetermined gaps from each other in the left-right direction 9, respectively. The recording paper 12 transported through the transport path 65 is supported by the platen 42, or in detail, by each of the ribs 52 formed on the upper surface of the platen 42.

A notch 67 (see FIG. 5) is formed in the front end portion of the platen 42. Then, a shaft 64 of the second transporting roller 62 is rotatably inserted into the notch 67. By virtue of this, the platen 42 is provided to be rotatable about the shaft 64 of the second transporting roller 62. That is, the platen 42 is formed to be movable by rotating about the shaft 64 of the second transporting roller 62. Further, in this embodiment, although the platen 42 is formed to rotate about the shaft 64, it may as well be formed to be movable by other movement manners than rotation. For example, the whole platen 42 may be formed to be movable along the up-down direction 7 by a publicly known cam mechanism or the like.

[The Recording Portion 24]

As shown in FIG. 2, the recording portion 24 is provided above the paper discharge path 65B to face the platen 42. The recording portion 24 includes a carriage 40 and a recording head 38. As shown in FIG. 3, the carriage 40 is supported by guide rails 43 and 44 provided on the rear side and front side of the platen 42, respectively. At least one of the guide rails 43 and 44 is provided with a known belt mechanism, and the carriage 40 is connected to the belt mechanism. By virtue of this, the carriage 40 is movable in the left-right direction 9.

As shown in FIG. 2, the recording head 38 is placed on the carriage 40. The plurality of nozzles 39 (an example of the nozzles of the present teaching) are formed on the lower surface of the recording head 38. The recording head 38 is supplied with ink from an ink cartridge (not shown). The recording head 38 jets tiny ink droplets from the nozzles 39. When the carriage 40 is reciprocating in the left-right direction 9, the ink droplets are jetted from the nozzles 39 onto the recording paper 12 supported on the platen 42. By virtue of this, images are recorded on the recording paper 12.

[The First Transporting Roller 60 and the Pinch Roller 61]

As shown in FIG. 2, the first transporting roller 60 and the pinch roller 61 are provided in the transport path 65 on the upstream side to the recording portion 24 in the transporting direction. The first transporting roller 60 is provided above the transport path 65. The pinch roller 61 is arranged below the transport path 65 to face the first transporting roller 60.

Figure 9A:
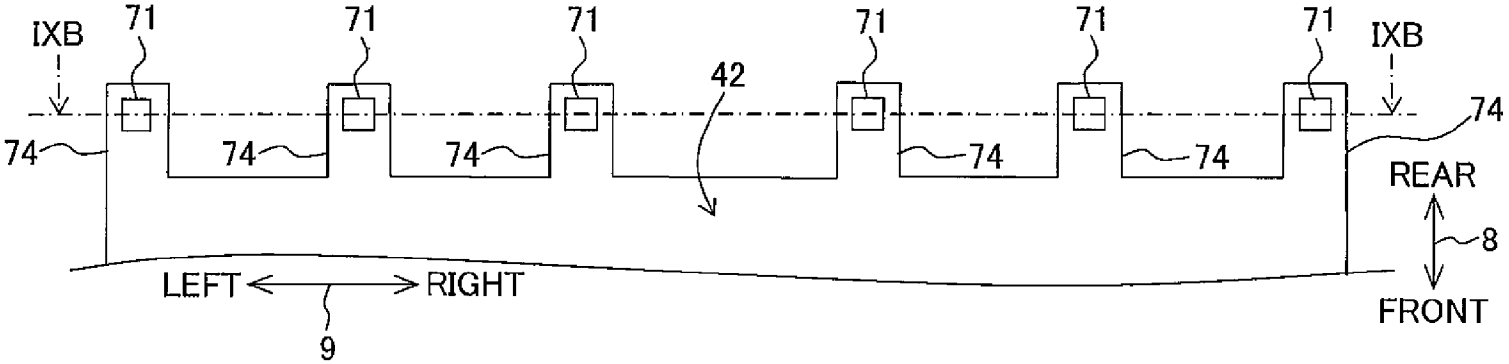
FIG. 9A is a plan view of the rear end portion of the platen 42.
Figure 9B:
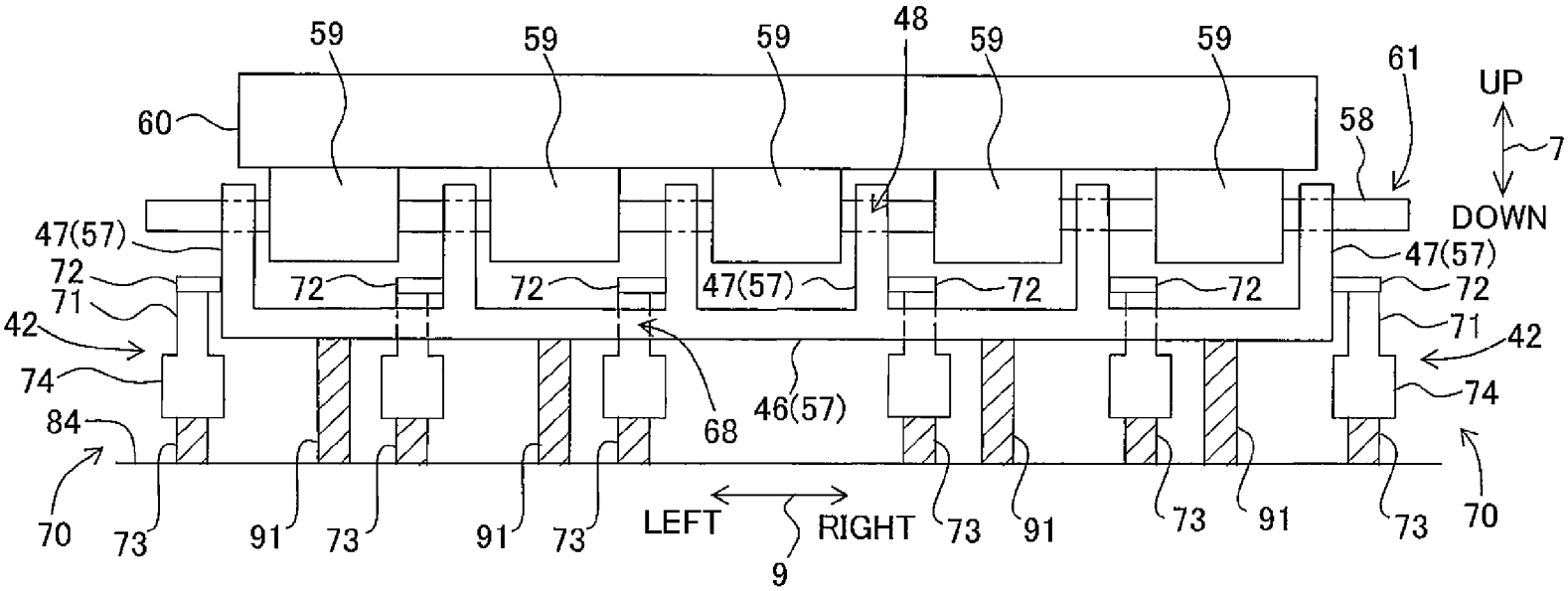
FIG. 9B is a cross-sectional view taken along the line A-A of FIG. 9A, showing the first transporting roller 60, the pinch roller 61 and a holder 57 in addition to the platen 42.

As shown in FIGS. 5 and 9B, the pinch roller 61 is constructed by a plurality of rotators 59 arranged apart from each other in the left-right direction 9, and a common shaft 58 for the plurality of rotators 59.

The shaft 58 of the pinch roller 61 is rotatably supported by a holder 57 (an example of the supporting member of the present teaching) between the respective rotators 59, as will be described below in detail. In this embodiment, the holder 57 is constructed by a bottom plate 46, and a plurality of support portions 47 formed to project upward from the bottom plate 46. The support portions 47 are provided at predetermined gaps in the left-right direction 9. A hole 48 is formed in each of the support portions 47 along the left-right direction 9. The shaft 58 of the pinch roller 61 is inserted through the holes 48.

A plurality of first coil springs 91 (an example of the first biasing member of the present teaching) are arranged below the holder 57. The first coil springs 91 support the holder 57 from below. Further, the first coil springs 91 are fixed to a frame 84 of the printer section 11 on the lower ends. By virtue of this, the pinch roller 61 is biased by the first coil springs 91 and pressed onto the roller surface of the first transporting roller 60. In other words, the first coil springs 91 bias the pinch roller 61 toward the first transporting roller 60, i.e. bias it upward. By virtue of this, the recording paper 12 is sandwiched between the first transporting roller 60 and the pinch roller 61, and transported along the transport path 65 in the transporting direction.

If a comparatively thick sheet of the recording paper 12 is sandwiched between the first transporting roller 60 and the pinch roller 61, then the pinch roller 61 is pressed by the recording paper 12 so as to move downward in resistance to the upward biasing force of the first coil springs 91. By virtue of this, the pinch roller 61 is separated from the first transporting roller 60. At this time, the holder 57 supporting the pinch roller 61 is moved downward integrally with the pinch roller 61. After the thick sheet of the recording paper 12 passes through the interspace between the first transporting roller 60 and the pinch roller 61, the pinch roller 61 is no longer pressed by the recording paper 12, and thus moved upward by the upward biasing force of the first coil springs 91. By virtue of this, the pinch roller 61 is pressed onto the first transporting roller 60. At this time, the holder 57 supporting the pinch roller 61 is moved upward integrally with the pinch roller 61.

On the other hand, if a comparatively thin sheet of the recording paper 12 is sandwiched between the first transporting roller 60 and the pinch roller 61, then the downward movement of the first transporting roller 60 is less in amount than that of the case in which a comparatively thick sheet of the recording paper 12 is sandwiched.

In the above manner, the pinch roller 61 moves in the up-down direction 7 (an example of the approaching and separating direction of the present teaching) to approach to and separate from the first transporting roller 60 according to the thickness of the recording paper 12 sandwiched between the first transporting roller 60 and the pinch roller 61.

[The Second Transporting Roller 62 and a Spur 63]

As shown in FIG. 2, the second transporting roller 62 and a spur 63 are provided in the paper discharge path 65B on the downstream side from the recording portion 24 in the transporting direction. The second transporting roller 62 is arranged below the paper discharge path 65B. The spur 63 is arranged above the second transporting roller 62 to face the second transporting roller 62. Further, the spur 63 is pressed onto the roller surface of the second transporting roller 62 by an elastic member (not shown) such as coil springs and the like. The second transporting roller 62 and the spur 63 sandwich the recording paper 12 with images recorded by the recording portion 24 to transport the same along the paper discharge path 65B in the transporting direction. By virtue of this, the recording paper 12 is discharged to the paper discharge tray 21.

Further, a driving force is transmitted from a transport motor (not shown) to the aforementioned first transporting roller 60 and second transporting roller 62 to rotate the both. By virtue of this, the recording paper 12 is transported in the transporting direction.

[The Holding Member 53]

As shown in FIG. 2, the holding member 53 (an example of the holding member of the present teaching) is provided in the transport path 65 on the upstream side to the recording portion 24 in the transporting direction. The holding member 53 is constructed by one fitting portion 56, a plurality of curved portions 54, and a plurality of holding portions 55, as shown in FIGS. 3 and 5. Further, in this embodiment, although the printer section 11 includes the holding member 53, it may as well not include the holding member 53.

The fitting portion 56 is a plate-like member provided to extend in the left-right direction 9. The plurality of curved portions 54 are fixed apart from each other in the left-right direction 9 (an example of the width direction of the present teaching). Each of the curved portions 54 is provided to project frontward from the fitting portion 56. Each of the curved portions 54 is curved downward while extending frontward. From the apical end, i.e. the front end of each of the curved portions 54, the holding portions 55 project frontward. By virtue of this, in the same manner as the curved portions 54, the plurality of holding portions 55 are also arranged apart from each other in the left-right direction 9.

As shown in FIGS. 3 and 5, the fitting portion 56 is fixed to the guide rail 43 as will be described below in detail. On the upper surface of the fitting portion 56, a plurality of catch portions 75 project upward. The catch portions 75 are flexed rearward in the upper end portions. On the other hand, a plurality of openings 45 are provided in the guide rail 43. Each of the catch portions 75 is inserted through one of the openings 45 to be hitched to the opening 45. By virtue of this, the upper surface of the fitting portion 56 of the holding member 53 is fixed to the lower surface of the guide rail 43.

As shown in FIGS. 2 to 5, each of the holding portions 55 is shaped into an approximately flat plate. Each of the holding portions 55 is provided on the upstream side to the nozzles 39 of the recording portion 24 in the transporting direction, and in a position facing the platen 42. The lower surface 51 of each holding portion 55 (an example of the holding portion of the present teaching; see FIG. 4) is positioned below the lower surface of the recording head 38, and contacts with the upper surface of the recording paper 12, that is, the image recording surface of the recording paper 12 supported on the platen 42 (in detail, on the ribs 52 formed on the platen 42). By virtue of this, the recording paper 12 is held down, i.e. toward the platen 42, by the lower surface 51 of each holding portion 55.

Figure 4:
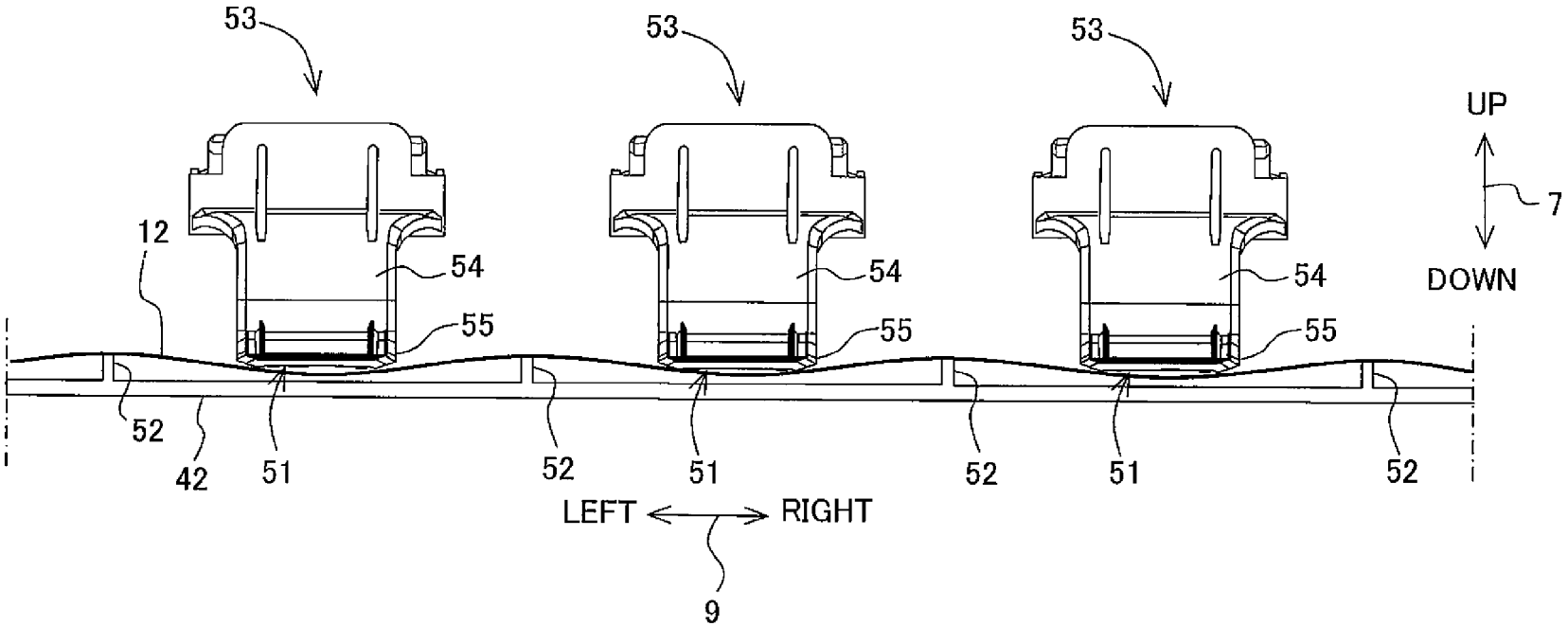
FIG. 4 is a front view showing the platen 42, a holding member 53, and a recording paper 12.

Here, as shown in FIG. 4, each rib 52 formed on the platen 42 is located where each holding portion 55 is not formed in the left-right direction 9. That is, the holding portions 55 and the ribs 52 do not face each other, respectively. Further, each rib 52 projects upward above the lower surface 51 of each holding portion 55. In the above manner, the recording paper 12 transported through the transport path 65 comes into an undulant state as viewed from the front side or rear side between the platen 42 and the holding portions 55.

[A Cooperative Portion 70]

As shown in FIGS. 5, 9A, 9B and 11, the printer section 11 includes a cooperative portion 70 (an example of the cooperative portion of the present teaching). The cooperative portion 70 includes the aforementioned holder 57 of the pinch roller 61, contact portions 71 (an example of the contact portion of the present teaching), contacted portions 72 (an example of the contacted portion of the present teaching), and second coil springs 73 (an example of the second biasing member of the present teaching).

As shown in FIGS. 5, 9A, 9B and 11, on the platen 42, the contact portions 71 are formed to contact with the holder 57 of the pinch roller 61.

In this embodiment, as shown in FIG. 9A, from the rear end portion of the platen 42, a plurality of protrusions 74 extend rearward and stand apart from each other in the left-right direction 9. The contact portions 71 extend upward from the end portions of the protrusions 74, respectively. Further, as described hereinbefore, the platen 42 rotates about the shaft 64 of the second transporting roller 62 inserted in the notch 67 in the front end portion. That is, the contact portions 71 are formed in the rotating end portion of the platen 42. Here, as described hereinbefore, the plurality of protrusions 74 are provided apart from each other in the left-right direction 9. Therefore, the plurality of contact portions 71 formed on the protrusions 74 are also provided apart from each other in the left-right direction 9.

Further, as shown in FIG. 9B, the plurality of contact portions 71 are provided apart symmetrically from the central portion of the platen 42 in the left-right direction 9. In this embodiment, the plurality of contact portions 71 respectively contact with the contacted portions 72 formed on the holder 57 of the pinch roller 61 between the respective rotators 59 of the pinch roller 61. Further, in the positions of the bottom plate 46 of the holder 57 facing the contact portions 71, there are formed openings 68 through which the contact portions 71 are inserted. By virtue of this, the contact portions 71 are contactable with the contacted portions 72.

As shown in FIGS. 5, 9A, 9B and 11, on the holder 57 of the pinch roller 61, the contacted portions 72 are formed to be contacted by the contact portions 71.

In this embodiment, the contacted portions 72 are, as shown in FIG. 9B, projections extending rightward or leftward from the side surfaces of the support portions 47 of the holder 57. Here, as described hereinbefore, the support portions 47 are provided at predetermined gaps in the left-right direction 9. Thereby, the plurality of contacted portions 72 formed on the support portions 47 are also provided apart in the left-right direction 9.

Further, the plurality of contacted portions 72 are provided apart symmetrically from the central portion of the platen 42 in the left-right direction 9. In this embodiment, the plurality of contacted portions 72 are provided to face the contact portions 71 in the up-down direction 7, respectively. By virtue of this, the lower surfaces of the contacted portions 72 are contacted by the upper surfaces of the contact portions 71.

As shown in FIGS. 5, 9A, 9B and 11, on the lower side of the platen 42, the second coil springs 73 are provided to bias the platen 42 toward the holder 57 of the pinch roller 61. The plurality of second coil springs 73 are provided in the positions facing the contact portions 71 and the contacted portions 72 in the left-right direction 9. That is, the second coil springs 73 support the protrusions 74 of the platen 42 from below, respectively. Further, each of the second coil springs 73 is fixed to the frame 84 of the printer section 11 on the lower end. By virtue of this, the platen 42 is biased by the second coil springs 73, and the upper surfaces of the contact portions 71 are pressed onto the lower surfaces of the contacted portions 72.

As described above, the plurality of protrusions 74 of the platen 42 are provided apart from each other in the left-right direction 9. Thereby, the plurality of second coil springs 73 formed on the lower side of the protrusions 74 are also provided apart in the left-right direction 9.

Further, as described above, the plurality of second coil springs 73 are provided in the positions facing the contact portions 71 and the contacted portions 72 in the left-right direction 9. Here, as described above, the plurality of contact portions 71 and the plurality of contacted portions 72 are provided apart symmetrically from the central portion of the platen 42 in the left-right direction 9. Thereby, the plurality of second coil springs 73 are also provided apart symmetrically from the central portion of the platen 42 in the left-right direction 9. By virtue of this, the second coil springs 73 bias the platen 42 toward the holder 57 of the pinch roller 61 from the left end portion to the right end portion. That is, the second coil springs 73 bias at least the central portion of the platen 42 to the holder 57 of the pinch roller 61 in the left-right direction 9.

[Operation of the Cooperative Portion 70]

Hereinbelow, referring to FIGS. 6 to 8, explanations will be made with respect to the operation of the cooperative portion 70 when the recording paper 12 is transported through the transport path 65, as well as to the movements of the platen 42 and the pinch roller 61 based on the operation of the cooperative portion 70.

Figure 6:
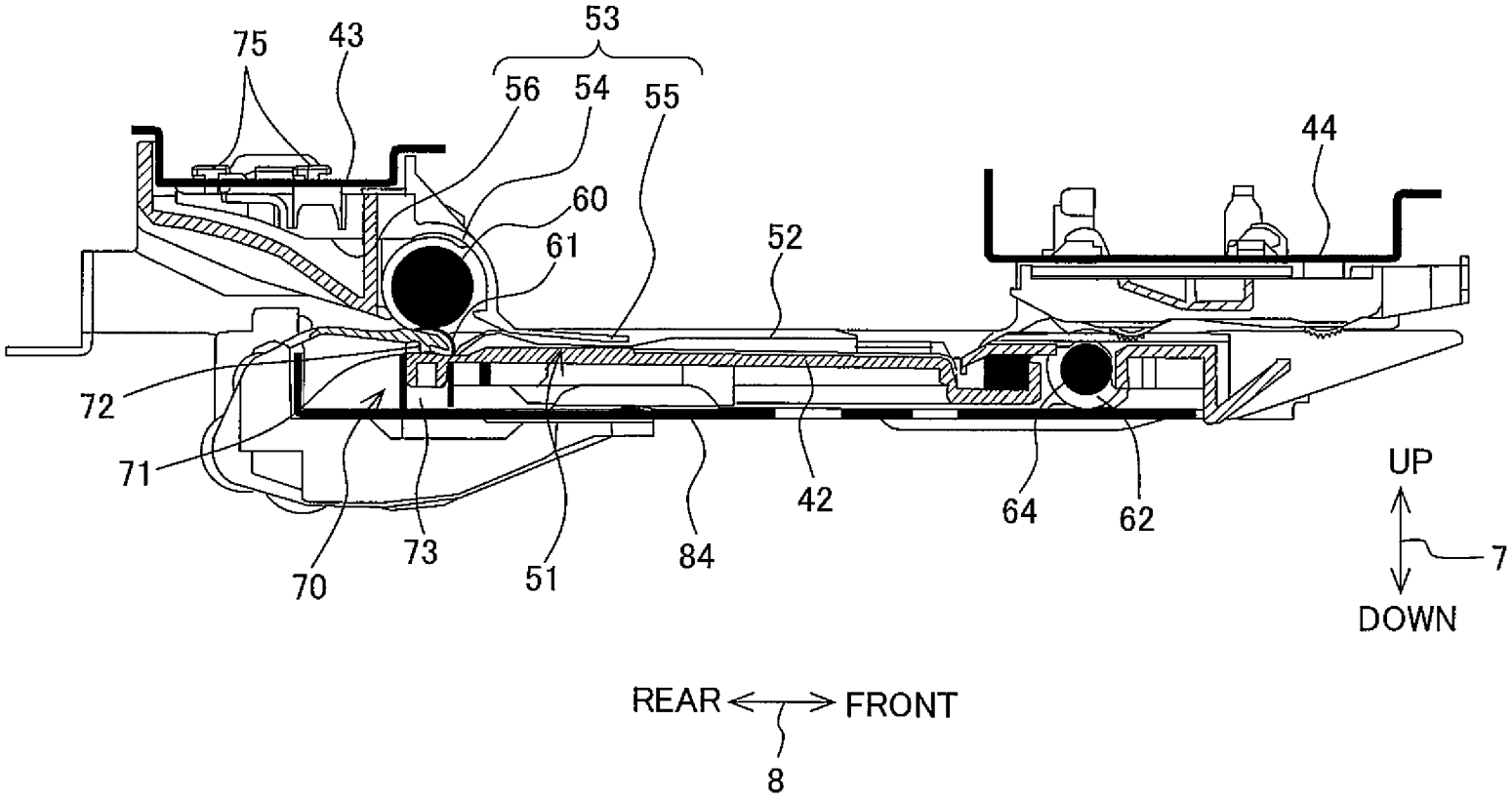
FIG. 6 is a longitudinal sectional view showing a periphery of the platen 42 in the printer portion 11, wherein the first transporting roller 60 is in contact with the pinch roller 61.
Figure 10A:
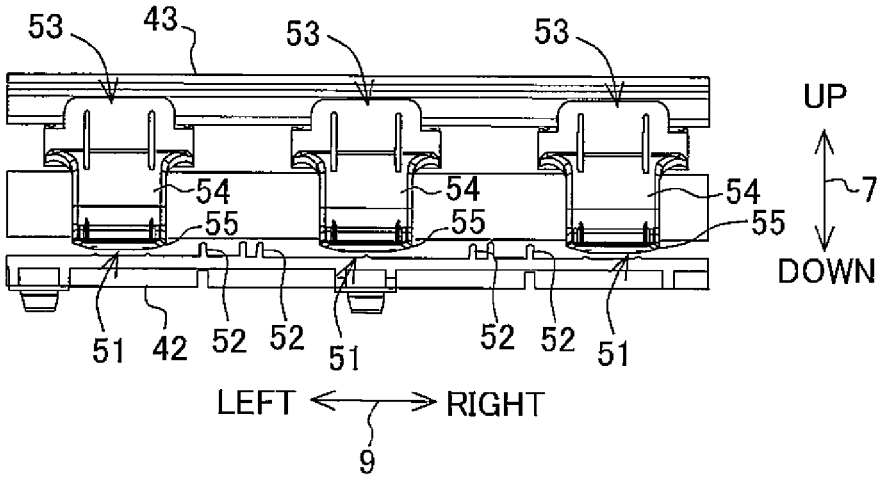
FIG. 10A is a front view showing the platen 42 and the holding member 53, wherein the recording paper 12 is not being transported.

As shown in FIG. 6, when the recording paper 12 is not transported through the transport path 65, the pinch roller 61 is biased upward by the first coil springs 91 (see FIG. 9B) via the holder 57. Further, when the recording paper 12 is not transported through the transport path 65, the platen 42 is biased upward by the second coil springs 73. By virtue of this, the contacted portions 72 of the holder 57 of the pinch roller 61 are pressed onto the contact portions 71 of the platen 42. In the above manner, the pinch roller 61 is biased by the first coil springs 91 and the second coil springs 73 and pressed onto the first transporting roller 60. Further, at this time, as shown in FIG. 10A, the upper ends of the ribs 52 are positioned above the lower surfaces 51 of the holding portions 55.

First, explanations will be made for the case of transporting the recording paper 12 with a low rigidity and almost no thickness such as plain paper and the like through the transport path 65. When the recording paper 12 is sandwiched by the first transporting roller 60 and the pinch roller 61, the pinch roller 61 and the holder 57 almost do not move downward. It is because the recording paper 12 has almost no thickness.

Figure 10B:
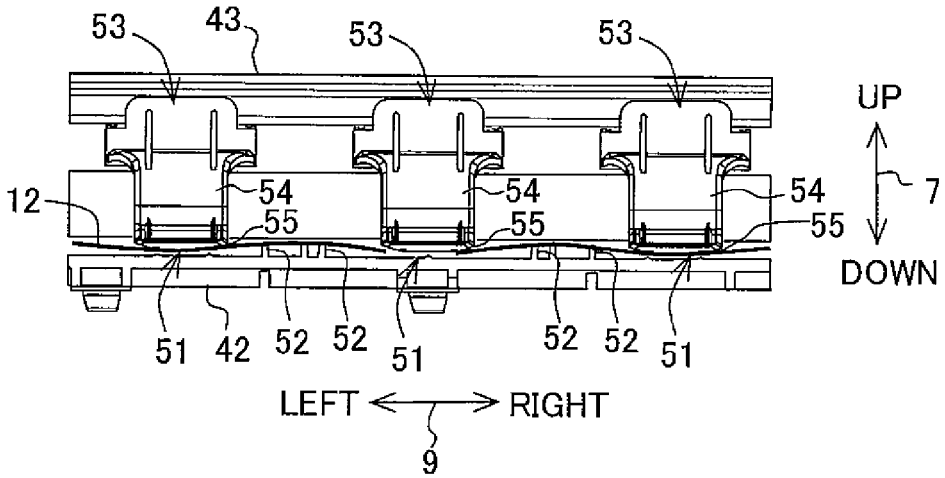
FIG. 10B is another front view showing the platen 42 and the holding member 53, wherein the low-rigidity recording paper 12 is being transported.

Next, if the recording paper 12 sandwiched by the first transporting roller 60 and the pinch roller 61 is further transported in the transporting direction, then the recording paper 12 comes right under the holding portions 55 of the holding member 53. By virtue of this, the recording paper 12 comes into a sandwiched state between the platen 42 and the lower surfaces 51 of the holding portions 55. At this time, the upper ends of the ribs 52 maintain the position above the lower surfaces 51 of the holding portions 55. However, because of the low rigidity, the recording paper 12 cannot press the ribs 52 downward. Therefore, right under the holding member 53, the upper surface of the recording paper 12 contacts with the lower surfaces 51 of the holding portions 55. On the other hand, right above the ribs 52, the lower surface of the recording paper 12 contacts with the upper ends of the ribs 52 positioned above the lower surfaces 51 of the holding portions 55. As a result, as shown in FIG. 10B by the chain line, the recording paper 12 is in an undulant state or waved state in the left-right direction 9. Then, the recording paper 12 is transported through the transport path 65 while maintaining the undulant state.

Next, explanations will be made for the case of transporting a high-rigidity sheet of the recording paper 12 thicker than plain paper such as glossy paper and the like through the transport path 65. As shown in FIG. 7, as the first transporting roller 60 and the pinch roller 61 sandwich the recording paper 12 transported through the transport path 65 in the transporting direction, the pinch roller 61 and the holder 57 are pressed by the recording paper 12 to move downward in resistance to the biasing force of the first coil springs 91. When the holder 57 moves downward, the contacted portions 72 press the contact portions 71 downward. By virtue of this, the platen 42 moves downward in resistance to the biasing force of the second coil springs 73. Here, the platen 42 moves downward corresponding to the pressing force applied by the contacted portions 72. That is, the downward movement of the pinch roller 61 is the same in amount as the downward movement of the platen 42. In other words, the cooperative portion 70 operates in accord with the movement of the pinch roller 61 in the up-down direction 7 to move the platen 42 while keeping the same distance from the pinch roller 61 in the up-down direction 7.

Figure 8:
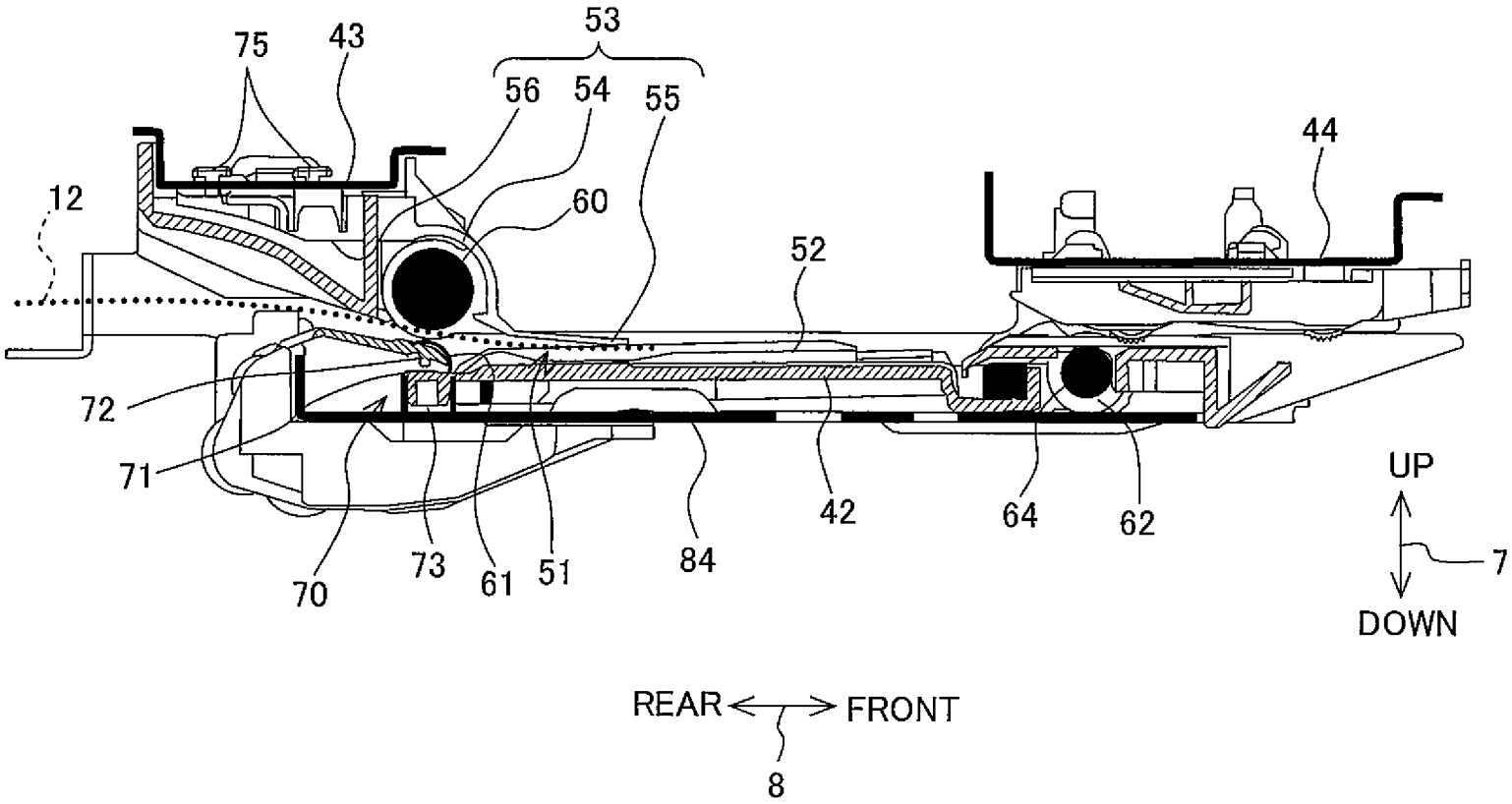
FIG. 8 is still another longitudinal sectional view showing the periphery of the platen 42 in the printer portion 11, wherein the platen 42 has moved below the state shown in FIG. 7.
Figure 10C:
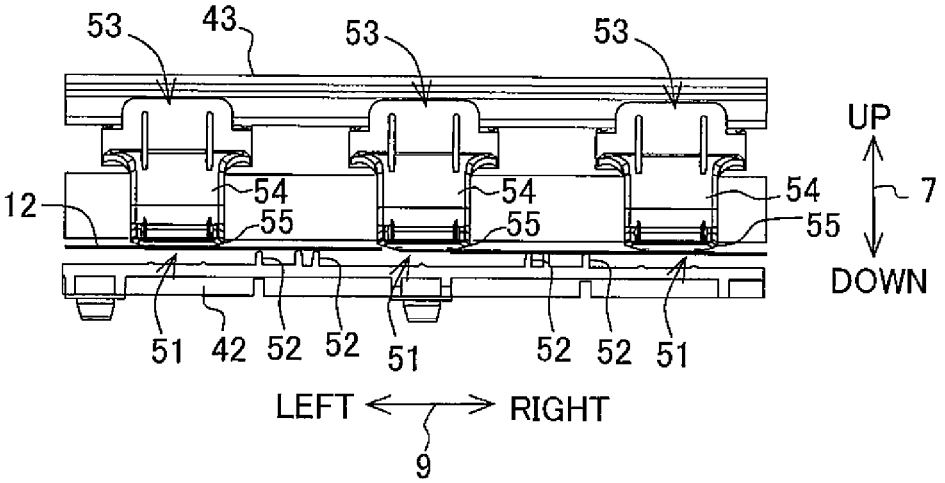
FIG. 10C is still another front view showing the platen 42 and the holding member 53, wherein the high-rigidity recording paper 12 is being transported.
Figure 11:
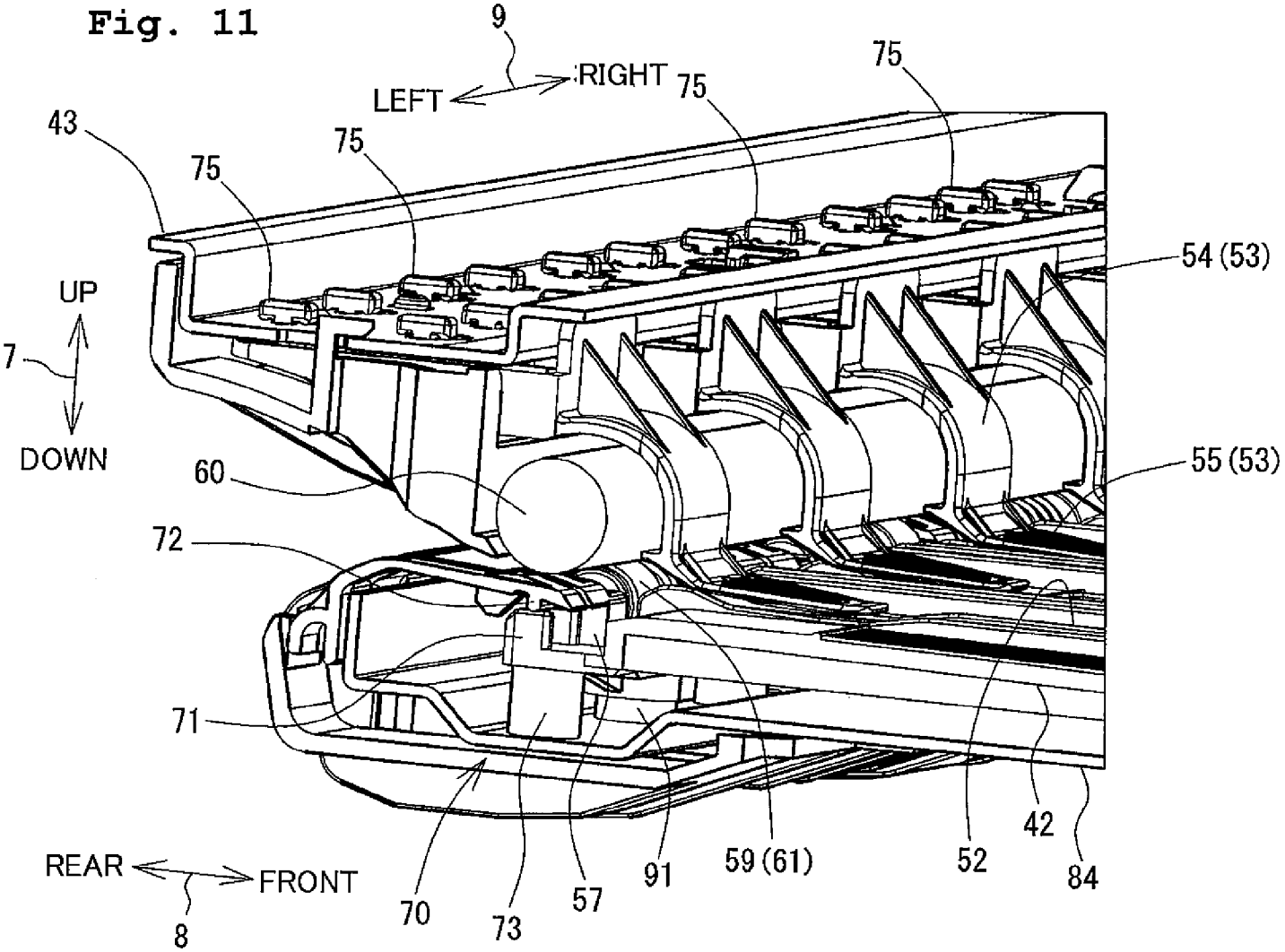
FIG. 11 is a perspective view showing a periphery of a cooperative portion 70.

As shown in FIG. 8, if the recording paper 12 sandwiched by the first transporting roller 60 and the pinch roller 61 is further transported in the transporting direction, then the recording paper 12 comes right under the holding portions 55 of the holding member 53. By virtue of this, the recording paper 12 comes into a sandwiched state between the platen 42 and the lower surfaces 51 of the holding portions 55. Therefore, the recording paper 12 is in a state of being pressed downward by the lower surfaces 51 of the holding portions 55. By virtue of this, because the ribs 52 are pressed downward by the recording paper 12, the platen 42 moves downward in resistance to the biasing force of the second coil springs 73. As a result, the contact portions 71 of the platen 42 depart from the contacted portions 72 of the pinch roller 61. That is, the platen 42 departs from the pinch roller 61 and moves downward. As a result of the movement of each member in the above manner, as shown in FIG. 10C with the chain line, the recording paper 12 comes into a sandwiched state between the lower surfaces 51 of the holding portions 55 and the ribs 52 of the platen 42.

In the above manner, by sandwiching the recording paper 12 between the platen 42 and the lower surfaces 51 of the holding portions 55, the cooperative portion 70 moves the platen 42 to extend the distance from the pinch roller 61 in the up-down direction 7. Further, by sandwiching the recording paper 12 between the platen 42 and the lower surfaces 51 of the holding portions 55, in resistance to the biasing force of the second coil springs 73, the platen 42 moves in such a direction that the contact portions 71 depart from the contacted portions 72.

On the other hand, even if the recording paper 12 is sandwiched between the platen 42 and the lower surfaces 51 of the holding portions 55, the pinch roller 61 is not ever moved below the state in FIG. 7. That is, when the recording paper 12 is sandwiched between the platen 42 and the lower surfaces 51 of the holding portions 55, the holder 57 of the pinch roller 61 is kept at position by the biasing force of the first coil springs 91 in the up-down direction 7.

If the rear end of the recording paper 12 in the transporting direction passes through the position sandwiched by the first transporting roller 60 and the pinch roller 61, then the pinch roller 61 moves upward due to the biasing force of the first coil springs 91, and is pressed onto the first transporting roller 60. By virtue of this, the holder 57 also moves upward. However, because the recording paper 12 is still in a state of being sandwiched between the lower surfaces 51 of the holding portions 55 and the ribs 52 of the platen 42, the platen 42 does not move upward. As a result, the contacted portions 72 of the holder 57 and the contact portions 71 of the platen 42 depart from each other. Thereafter, if the rear end of the recording paper 12 in the transporting direction passes through the interspace between the platen 42 and the lower surfaces 51 of the holding portions 55, then the platen 42 moves upward due to the biasing force of the second coil springs 73. By virtue of this, the upper surfaces of the contact portions 71 are again pressed onto the lower surfaces of the contacted portions 72. As a result, the cooperative portion 70 becomes in the state as shown in FIG. 6.

Effects of the Embodiment

According to the above embodiment, by sandwiching the recording paper 12 with the first transporting roller 60, the pinch roller 61 moves in the up-down direction 7 by a distance as long as the thickness of the recording paper 12. If the pinch roller 61 moves in the up-down direction 7, then the platen 42 supporting the recording paper 12 is moved by the cooperative portion 70 while keeping the constant distance from the pinch roller 61 in the up-down direction 7. That is, the movement distance of the platen 42 in the up-down direction 7 is the same as the thickness of the recording paper 12. In the above manner, according to this embodiment, without depending on the thickness of the recording paper 12, it is possible to keep an invariant gap between the recording portion 24 and the recording paper 12 supported on the platen 42.

Further, according to this embodiment, the recording paper 12 supported on the platen 42 is held down by the holding member 53 and sandwiched between the platen 42 and the holding member 53 to be in an undulant state in the left-right direction 9. By virtue of this, it is possible to raise the rigidity of a low-rigidity sheet of the recording paper 12 in the front-rear direction 8. As a result, it is possible to restrain deformation and jam of the recording paper 12 even in the transport after recording.

Further, in the case of sandwiching such a sheet of the recording paper 12 as with a high rigidity that the holding member 53 cannot absorb its deformation between the platen 42 and the holding member 53, the platen 42 moves downward by a longer distance than in the case that the recording paper 12 is sandwiched by the first transporting roller 60 and the pinch roller 61 but not sandwiched by the platen 42 and the holding member 53. By virtue of this, it is possible to apply the height standard of the recording paper 12 supported on the platen 42 to the height of the position held down by the holding member 53.

Further, according to this embodiment, the ribs 52 are elongated along the transporting direction. Therefore, the ribs 52 can support the recording paper 12 over a wide range. As a result, it is possible to improve the transport precision of the recording paper 12.

Further, according to this embodiment, it is possible to realize the cooperative portion 70 with a simple configuration including the contact portions 71, the contacted portions 72, and the like. Further, according to this embodiment, if the first transporting roller 60 is arranged above the pinch roller 61, then when the recording paper 12 is sandwiched between the platen 42 and the holding member 53, the contact portions 71 formed on the platen 42 are pressed by the recording paper 12 to depart from the contacted portions 72 formed on the holder 57 of the pinch roller 61. That is, the platen 42 is movable independently of the holder 57 (the pinch roller 61). In other words, even if the movement distance of the platen 42 becomes longer in the up-down direction 7, the pinch roller 61 still does not move beyond necessity. In the above manner, according to this embodiment, it is possible to prevent the pinch roller 61 from departing more than necessary from the first transporting roller 60.

Further, according to this embodiment, the rotating end portion of the platen 42 is pressed on the holder 57 of the pinch roller 61 due to the biasing force of the second coil springs 73. Further, the pinch roller 61 supported by the holder 57 is pressed on the first transporting roller 60 due to the biasing force of the first coil springs 91. That is, the revolving end portion of the platen 42 is in a state of being pressed on the first transporting roller 60.

In the above manner, it is possible to set the rotating end portion of the platen 42 along the first transporting roller 60 fixed on the multifunction printer 10 in the left-right direction 9. Here, in this embodiment, the second coil springs 73 bias the central portion of the platen 42 in the left-right direction 9 to the holder 57 of the pinch roller 61. Therefore, it is easy to set the rotating end portion of the platen 42 along the first transporting roller 60.

Since the rotating end portion of the platen 42 is set along the first transporting roller 60 fixed on the multifunction printer 10, it is possible to fix the gap between the recording portion 24 and the recording paper 12 supported on the platen 42. Thereby, in recording an image on the recording paper 12, it is possible to reduce quality degradation of the image recorded on the recording paper 12 by controlling the nozzles 39 based on the warpage of the platen 42.

Further, as is understood from this embodiment, it is possible to set the platen 42 along the first transporting roller 60 more accurately by providing a larger number of the second coil springs 73.

Further, according to this embodiment, the pinch roller 61 moves downward by a distance in accordance with the thickness of the recording paper 12 sandwiched between the first transporting roller 60 and the pinch roller 61. Further, the platen 42 also moves downward while keeping the distance from the pinch roller 61 in the up-down direction 7. By virtue of this, it is possible to secure a smaller entry angle when the recording paper 12 enters into the support position by the platen 42 from the support position by the pinch roller 61. As a result, because the entry angle becomes smaller, it is possible to reduce the probability that the recording paper 12 is caught on the platen 42 and jammed inside the transport path 65.

[First Modification]

In the above embodiment, the holding member 53 is configured as a single-body member. In particular, the holding member 53 is configured such that the plurality of curved portions 54 project from the fitting portion 56 provided to extend in the left-right direction 9. However, a plurality of holding members 53 may as well be provided.

For example, a plurality of fitting portions 56 of the holding members 53 may as well be provided according to the plurality of curved portions 54, respectively. That is, it is also possible to provide a plurality of holding members 53 each composed of one fitting portion 56, one curved portion 54 and one holding portion 55. Further, in the first modification, each of the fitting portions 56 is fixed to the guide rail 43 at a predetermined gap in the left-right direction 9.

[Second Modification]

In the above embodiment, on the upper surface of the platen 42, the ribs 52 are formed to extend in the front-rear direction 8. Then, the recording paper 12 is brought into an undulant state due to the ribs 52 and the holding member 53. However, instead of the ribs 52, a short projection with respect to the front-rear direction 8 may as well be formed on the upper surface of the platen 42. In the second modification, this projection is provided at least at the same position as the holding member 53 in the front-rear direction 8, but at a different position from the holding member 53 in the left-right direction 9. Further, a plurality of projections may as well be provided at predetermined gaps along the front-rear direction 8.

[Third Modification]

In the above embodiment, the plurality of contact portions 71, contacted portions 72 and second coil springs 73 are provided apart symmetrically from the central portion of the platen 42. However, the arrangement of the contact portions 71, contacted portions 72 and second coil springs 73 is not limited to that in the above embodiment.

For example, the contact portions 71, contacted portions 72 and second coil springs 73 may as well be arranged only at both ends of the platen 42 in the left-right direction 9.

Further, just one contact portion 71, one contacted portion 72 and one second coil spring 73 may as well be arranged in the central portion of the platen 42 in the left-right direction 9.

[Fourth Modification]

In the above embodiment, the configuration of the printer section 11 provided with the holding member 53 is explained. However, the printer section 11 may as well not be provided with the holding member 53. In this case, the cooperative portion 70 operates as follows.

When the recording paper 12 is not transported through the transport path 65, in the same manner as in FIG. 6 of the above embodiment, biased by the first coil springs 91 and the second coil springs 73, the pinch roller 61 is pressed on the first transporting roller 60. Further, the platen 42 is biased by the second coil springs 73, and thus the contacted portions 72 of the holder 57 of the pinch roller 61 are pressed on the contact portions 71 of the platen 42.

Figure 7:
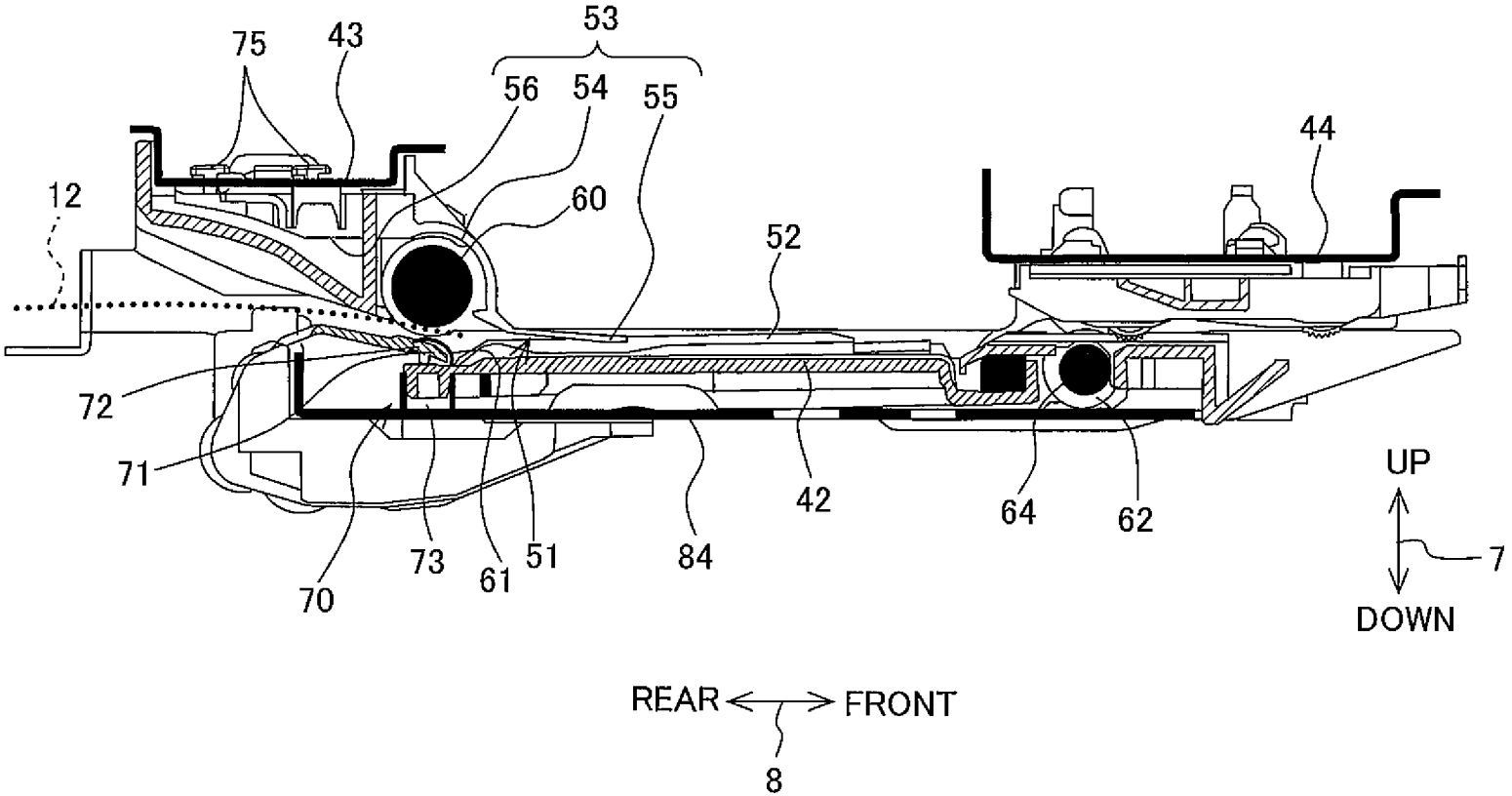
FIG. 7 is another longitudinal sectional view showing the periphery of the platen 42 in the printer portion 11, wherein the first transporting roller 60 is apart from the pinch roller 61.

If the recording paper 12 transported through the transport path 65 is sandwiched by the first transporting roller 60 and the pinch roller 61, then in the same manner as in FIG. 7 of the above embodiment, the pinch roller 61 and the holder 57 move downward in resistance to the biasing force of the first coil springs 91. Further, when the holder 57 moves downward, the contacted portions 72 press the contact portions 71 downward. By virtue of this, the platen 42 moves downward in resistance to the biasing force of the second coil springs 73. That is, because the contact portions 71 are pressed by the contacted portions 72, the platen 42 moves in resistance to the biasing force of the second coil springs 73.

If the rear end of the recording paper 12 in the transporting direction passes through the position sandwiched by the first transporting roller 60 and the pinch roller 61, then the pinch roller 61 moves upward due to the biasing force of the first coil springs 91, and is pressed onto the first transporting roller 60. If the pinch roller 61 moves upward, then the contact portions 71 pressed downward by the contacted portions 72 move upward following the contacted portions 72 due to the biasing force of the second coil springs 73. As a result, the contact portions 71 and the contacted portions 72 are maintained in a state of contact with each other.

According to the fourth modification, even without the holding member 53, it is still possible to realize the cooperative portion 70 with a simple configuration including the contact portions 71, the contacted portions 72, and the like.

[Fifth Modification]

In the above embodiment, the lower surfaces 51 of the holding portions 55 are an example of the holding portion of the present teaching, and the lower surfaces 51 contact with the upper surface of the recording paper 12. However, the holding portion of the present teaching is not limited to the lower surfaces 51 of the holding portions 55. For example, the holding portions 55 may be each provided with at least one rotatable spur (not shown). In this case, the spur contacts with the upper surface of the recording paper 12. That is, in the fifth modification, this spur is an example of the holding portion of the present teaching.

According to the fifth modification, because the spur is rotatable, it is possible to smoothly transport the recording paper 12 through under the holding member 53.

[Sixth Modification]

In the above embodiment, the first transporting roller 60 is provided above the transport path 65, while the pinch roller 61 is provided below the transport path 65. However, the first transporting roller 60 may as well be provided below the transport path 65, while the pinch roller 61 is then provided above the transport path 65. Further, in the same manner as in the above embodiment, the pinch roller 61 is also configured to be movable in the up-down direction 7 in the sixth modification. Further, in the sixth modification, the first coil springs 91 bias the pinch roller 61 downward.

Figure 12A:
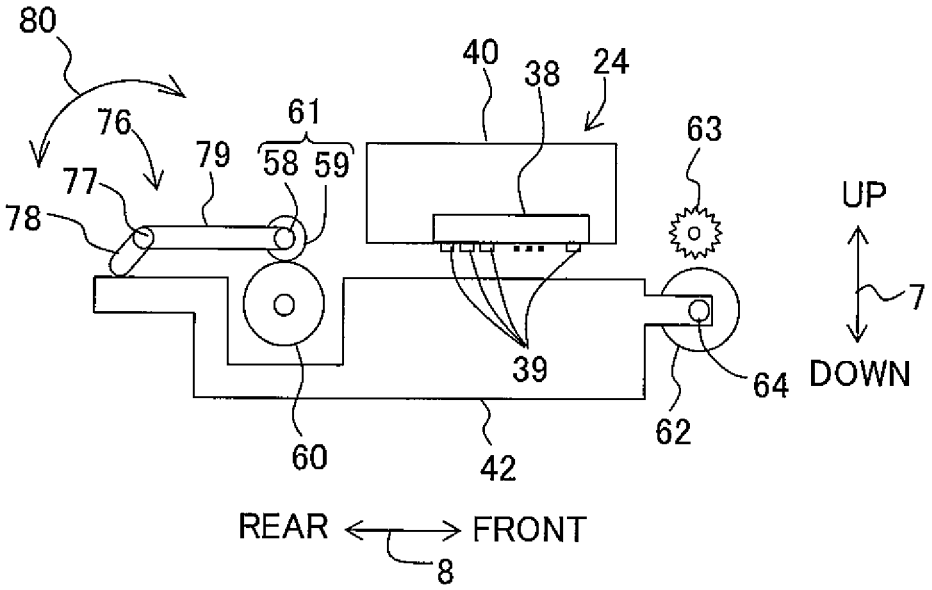
FIG. 12A is a longitudinal sectional view modally showing a periphery of a link member 76, the recording portion 24 and the platen 42, wherein the recording paper 12 is not being transported.
Figure 12B:
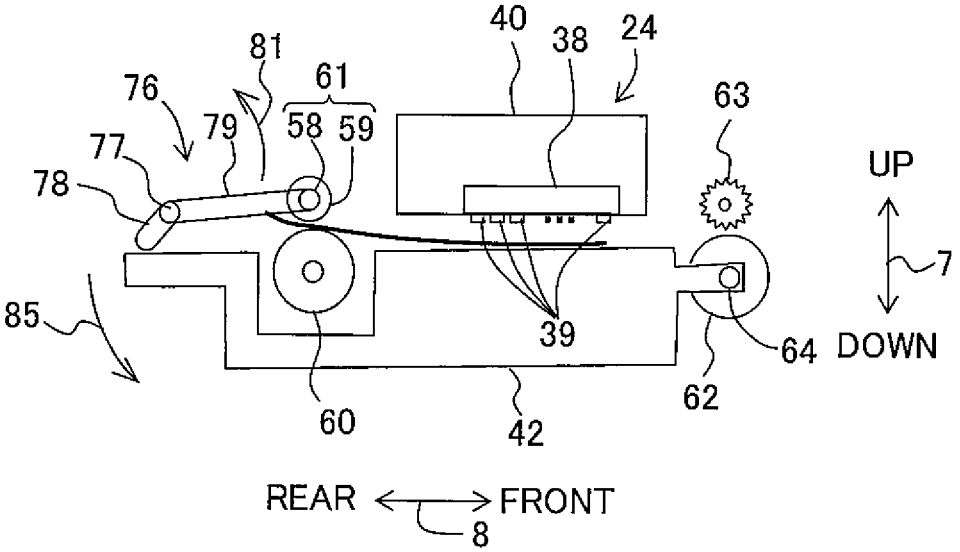
FIG. 12B is another longitudinal sectional view modally showing the periphery of the link member 76, the recording portion 24 and the platen 42, wherein the recording paper 12 is being transported.

In the sixth modification, the printer section 11 includes a link member 76 as shown in FIG. 12A as an example of the cooperative portion of the present teaching. FIGS. 12A and 12B show a working example of the case in which the printer section 11 does not include the holding member 53. Further, in the sixth modification, the printer section 11 may also include the holding member 53. Further, in FIGS. 12A and 12B, the first coil springs 91 biasing the pinch roller 61 to the first transporting roller 60, i.e., biasing it downward, are omitted. The link member 76 includes a shaft 77 rotatably supported by the frame (not shown) and the like of the printer section 11 on both ends in the left-right direction 9, a first arm 78 provided to extend from the shaft 77 toward the upper end of the platen 42, and a second arm 79 provided to extend from the shaft 77 toward the pinch roller 61. The link member 76 is rotatable about the shaft 77 in a direction along the arrow 80. Further, the first arm 78 is positioned outside of the transport path 65 in the left-right direction 9.

The extended end of the second arm 79 is fixed to the shaft 58 of the pinch roller 61. By virtue of this, as shown in FIG. 12B, if the pinch roller 61 is pressed by the recording paper 12 transported through the transport path 65 and thus moved along the arrow 80 in resistance to the biasing force of the first coil springs 91, then the link member 76 also rotates along the arrow 80. As a result, the platen 42 is pressed downward by the first arm 78 of the link member 76 to move downward. In other words, the platen 42 is pressed by the first arm 78 so as to rotate along the arrow 80 about the shaft 64 of the second transporting roller 62.

Further, if the recording paper 12 passes through the interspace between the first transporting roller 60 and the pinch roller 61, then the link member 76, the pinch roller 61 and the platen 42 operate reversely to the above, and thus transfer from the state of FIG. 12B to the state of FIG. 12A.

In the above manner, in the sixth modification too, the link member 76, an example of the cooperative portion of the present teaching, moves the platen 42 along with the movement of the pinch roller 61 in the up-down direction 7.

Except for unperformable cases, it is also possible to appropriately combine the abovementioned embodiment and one or more modifications as necessary.

What is claimed is:

1. An ink-jet recording apparatus comprising:

a transporting roller provided in a transport path through which a recording medium is guided;

a driven roller provided opposite the transporting roller to sandwich the recording medium between the driven roller and the transporting roller and to transport the recording medium along the transport path in a transporting direction;

a roller holder rotatably supporting the driven roller and configured to move in an approaching-departing direction along which the driven roller approaches and departs from the transporting roller based on a thickness of the recording medium sandwiched between the driven roller and the transporting roller;

a first biasing member biasing the roller holder toward the transporting roller;

a recording head provided above the transport path and including nozzles which eject ink droplets;

a first contact member configured to contact a first surface of the recording medium; and a second contact member configured to contact a second surface of the recording medium opposite to the first surface of the recording medium, wherein the first contact member and the second contact member are configured to sandwich the recording medium at a position between the transporting roller and the nozzles with respect to the transporting direction, and wherein the roller holder is configured to, when moving away from the transporting roller, press the second contact member and change a distance between the first contact member and the second contact member with respect to the approaching-departing direction.

2. The ink-jet recording apparatus according to claim 1, further comprises a second biasing member biasing the second contact member toward the first contact member.

3. The ink-jet recording apparatus according to claim 1, wherein the second contact member is provided below the transport path to face the recording head and configured to support, on a downstream side of the transporting roller in the transporting direction, the recording medium transported through the transport path.

* * * * *